US008523306B2

(12) United States Patent
Ishikawa

(10) Patent No.: US 8,523,306 B2
(45) Date of Patent: Sep. 3, 2013

(54) LIQUID SUPPLY DEVICE AND PRINTING APPARATUS INCLUDING THE SAME

(75) Inventor: Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 591 days.

(21) Appl. No.: 12/573,761

(22) Filed: Oct. 5, 2009

(65) Prior Publication Data

US 2010/0085394 A1 Apr. 8, 2010

(30) Foreign Application Priority Data

Oct. 7, 2008 (JP) ..... 2008-260708

(51) Int. Cl.
*B41J 29/38* (2006.01)

(52) U.S. Cl.
USPC ..... 347/6; 347/85

(58) Field of Classification Search
USPC ..... 347/6, 85
See application file for complete search history.

(56) References Cited

U.S. PATENT DOCUMENTS

| | | | | |
|---|---|---|---|---|
| 2001/0017641 | A1* | 8/2001 | Kobayashi et al. | 347/85 |
| 2005/0248634 | A1* | 11/2005 | Aruga | 347/85 |
| 2006/0071965 | A1* | 4/2006 | Igarashi et al. | 347/19 |
| 2008/0273046 | A1* | 11/2008 | Ishinaga et al. | 347/6 |
| 2009/0091779 | A1* | 4/2009 | Ishinaga et al. | 358/1.15 |

FOREIGN PATENT DOCUMENTS

| | | | |
|---|---|---|---|
| JP | 11-188894 | A | 7/1999 |
| JP | 2002-052737 | A | 2/2002 |
| WO | WO 2005118300 | A1 * | 12/2005 |
| WO | WO 2006129732 | A1 * | 12/2006 |

* cited by examiner

*Primary Examiner* — Charlie Peng
*Assistant Examiner* — Peter Radkowski
(74) *Attorney, Agent, or Firm* — Canon USA, Inc., IP Division

(57) ABSTRACT

A liquid supply device includes a pressure unit configured to generate a pressure to supply liquid to a printing unit, the printing unit configured to discharge the liquid and perform printing on a printing medium; a pressure detecting unit configured to detect the pressure generated by the pressure unit; and a control unit configured to drive the pressure unit with a power corresponding to a liquid consuming speed of the printing unit if the pressure detecting unit detects a lower pressure than a predetermined pressure while the printing unit discharges the liquid.

8 Claims, 6 Drawing Sheets

LIQUID SUPPLY DEVICE AND PRINTING APPARATUS INCLUDING THE SAME

BACKGROUND OF THE INVENTION

1. Field of the Invention

The present invention relates to a liquid supply device which applies a pressure to liquid and supplies the liquid, and a printing apparatus including the liquid supply device.

2. Description of the Related Art

In an inkjet printing apparatus of off-carriage type, a liquid container is mounted at a position different from the position of a carriage. The size of such a liquid container can be easily increased. In addition, since the weight of the carriage including a printing head can be easily decreased, a scanning speed can be increased. The off-carriage type is used for large-size printing or business use, in which a consumption of liquid is large and a printing speed is high.

A tube supply style provides stable and continuous liquid supply because a liquid container and a printing head are connected to each other through a tube. In many cases, the tube supply style employs a pressure supply system which applies a pressure to liquid in a passage and supplies printing head with the liquid. In the pressure supply system, the arrangement of the printing head and the liquid container is less restricted. Hence, the layout of units in the apparatus can be more freely determined.

In particular, an indirect pressure supply system, in which a pressure is applied to the outside of a liquid bag containing liquid, only uses a single pressure pump regardless of the number of types of liquid in the printing apparatus. Since the liquid does not directly contact parts defining a pump, the material of the parts can be freely selected. A pressure unit may be a bellows pump, a diaphragm pump, a tube pump, etc.

A technique, which controls a pressure of air for liquid supply with the indirect pressure supply system, is described in document 1 (Japanese Patent Laid-Open No. 2002-52737). In document 1, control is provided such that a pressure of pressure air is detected, and a pressure of a cartridge is selected between a printing condition and a cleaning condition with a larger liquid consumption. In particular, the control is provided as follows. In the printing condition, the pressure pump is driven until the pressure of the cartridge becomes a first preset pressure which can deal with a maximum discharge amount of liquid, and then the pressure pump is stopped. In the cleaning condition, the pressure pump is driven until the pressure becomes a second preset pressure which can deal with an exhaust amount of liquid, and then the pressure pump is stopped. The second preset pressure is higher than the first preset pressure. Also, document 2 (Japanese Patent Laid-Open No. 11-188894) focuses on a change in liquid viscosity depending on an ambient temperature. In a configuration described in document 2, a driving time of a pump is changed in accordance with an ambient temperature, to obtain a pressure corresponding to a temperature change.

The size of a printing apparatus has been desired to be decreased. The size of the printing apparatus with the indirect pressure supply system is also desired to be decreased. The printing apparatus may be placed on or beside a desk in an office or another location closely relating to the home life of a user. Printing apparatuses for photo printing and business use consume a large amount of liquid. A liquid bag with a large capacity is necessary for such a printing apparatus, and hence driving sound of a pump for applying a pressure to the liquid is increased. In the indirect pressure supply system, an ambient pressure of the liquid bag is decreased because liquid in the liquid bag is consumed or because of a pressure spontaneously leaks. Therefore, it is necessary to keep the ambient pressure of the liquid bag to a predetermined pressure during printing. The pressure pump is driven when the ambient pressure of the liquid bag becomes lower than a predetermined pressure, and the pressure pump is stopped when the ambient pressure becomes higher than the predetermined pressure. This operation is repeated.

A motor of a pressure pump of the related art is driven at a constant driving speed which reliably satisfies supplement of liquid. Documents 1 and 2 do not describe a driving speed of a pressure pump. In the configuration of either document, a driving time of a pressure pump is adjusted to change a pressure. In such a driving method, a motor is driven at an excessively high rotating speed. When the printing apparatus is used near the user, the user may have a problem of noise because large motor sound may be repeatedly turned on and off.

SUMMARY OF THE INVENTION

To reduce the driving sound, the driving speed of the motor may be decreased. However, merely decreasing the driving speed may not reliably provide a supply amount larger than a liquid consumption. If liquid supply is insufficient, discharge failure may occur. Alternatively, the pump serving as the pressure unit may be increased in size and the driving speed may be decreased. However, the entire printing apparatus may be increased in size, and a driving load may be increased, resulting in an increase in cost of a driving mechanism. In light of the situation, the present invention focuses on a driving speed of a pressure unit, the driving speed which is a factor of noise. The present invention controls the driving speed of the pressure unit in accordance with a liquid consuming speed of a printing unit, and reduces noise of a liquid supply device.

A liquid supply device according to an aspect of the present invention includes a pressure unit configured to generate a pressure to supply liquid to a printing unit, the printing unit configured to discharge the liquid and perform printing on a printing medium; a pressure detecting unit configured to detect the pressure generated by the pressure unit; and a control unit configured to drive the pressure unit with a power corresponding to a liquid consuming speed of the printing unit if the pressure detecting unit detects a lower pressure than a predetermined pressure while the printing unit discharges the liquid.

With the aspect, the pressure unit is driven at the driving speed suitable for the liquid consuming speed. Accordingly, the noise of the liquid supply device is reduced.

Further features of the present invention will become apparent from the following description of exemplary embodiments with reference to the attached drawings.

DESCRIPTION OF THE EMBODIMENTS

1. Printing Apparatus

Figure 1:
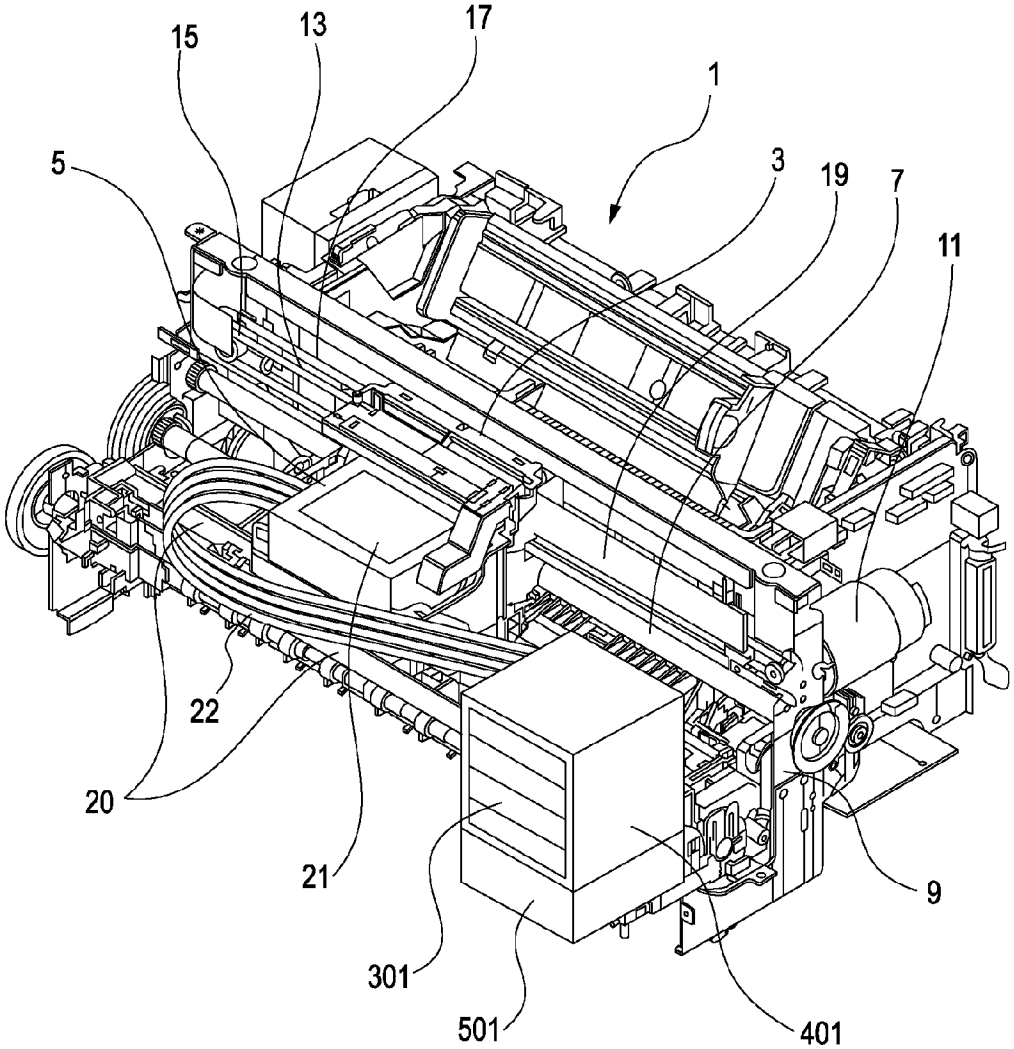
FIG. 1 is a perspective view showing an appearance of a printing apparatus according to an embodiment.

FIG. 1 is a perspective view briefly showing an inkjet printing apparatus according to an embodiment of the present invention. Reference numeral denotes a printer engine 1. A printing head 5 is mounted on a carriage 3. The carriage 3 is slidably attached to a guide shaft 7. The guide shaft 7 causes the carriage 3 to scan in a reciprocating manner in a direction perpendicular to a conveying direction of a sheet member. The carriage 3 is driven by a carriage motor 11 via a timing belt 13. The carriage motor 11 is attached to a chassis 9. The timing belt 13 is tensioned and supported by an idler pulley 15. A code strip 17 is provided in parallel to the timing belt 13. The code strip 17 has markings at a pitch ranging from 150 to 300 lpi. The markings are used to detect a position of the carriage 3. An encoder sensor (not shown) is mounted on the carriage 3. The encoder sensor reads the markings. The carriage 3 also includes a flexible substrate 19 which transmits a signal from an electric substrate (not shown) to the printing head 5.

In the above-described configuration, when an image is to be formed on a sheet member serving as a printing medium, a pair of conveying rollers 20 convey the sheet member to a line position for image formation (position in the conveying direction of the sheet member). The carriage 3 is driven by the carriage motor 11, and hence the carriage 3 scans while facing the sheet member. When the carriage 3 scans a row position for image formation (position perpendicular to the conveying direction of the sheet member), liquid is discharged from a discharge port of the printing head 5 and an image is formed in accordance with a signal from the electric substrate.

An auxiliary liquid container (subtank) 21 is integrally provided with the printing head 5. The subtank unit 21 contains a subtank for each type of liquid such as ink. In this embodiment, printing is available with inks of four colors including black, cyan, magenta, and yellow. Hence, four subtanks are provided. A supply tube 22 is formed of polyethylene, elastomer, etc. The supply tube 22 defines a passage between a subtank and a main liquid container (main tank) 301 which is stationary type and contains liquid. A holder 401 can hold a plurality of main tanks. The holder 401 provides a connection for between an air passage through which the air is pumped by a pressure pump (described later), and a tube through which the printing head is supplied with the liquid. A pressure pump unit 501 serves as a pressure unit.

2. Printing Head

Figure 2:
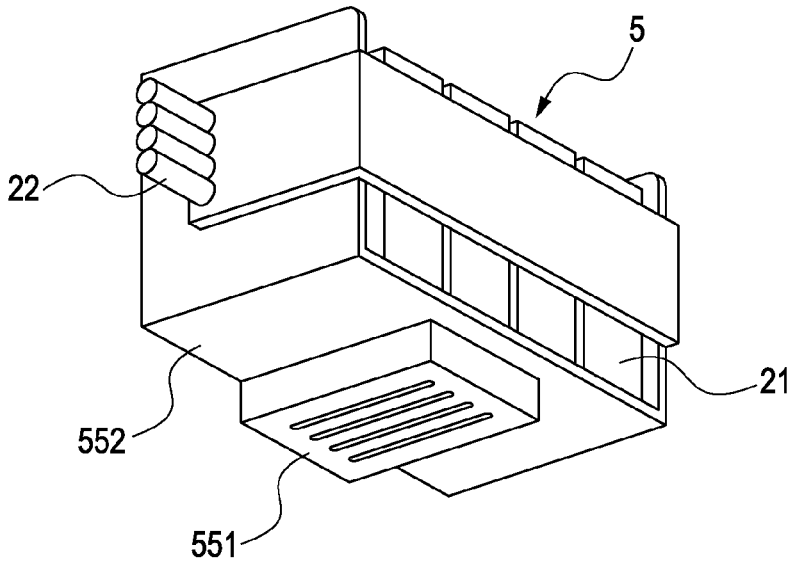
FIG. 2 is a perspective view briefly showing a printing head according to the embodiment.

FIG. 2 is a perspective view showing an appearance of the printing head 5 which is mounted on the printing apparatus in FIG. 1 and serves as a printing unit. The printing head 5 includes a carriage 552 on which the subtank 21 is mounted, and a chip portion 551 having a discharge port which discharges the liquid in the subtank 21.

3. Main Tank, Subtank

Figure 4:
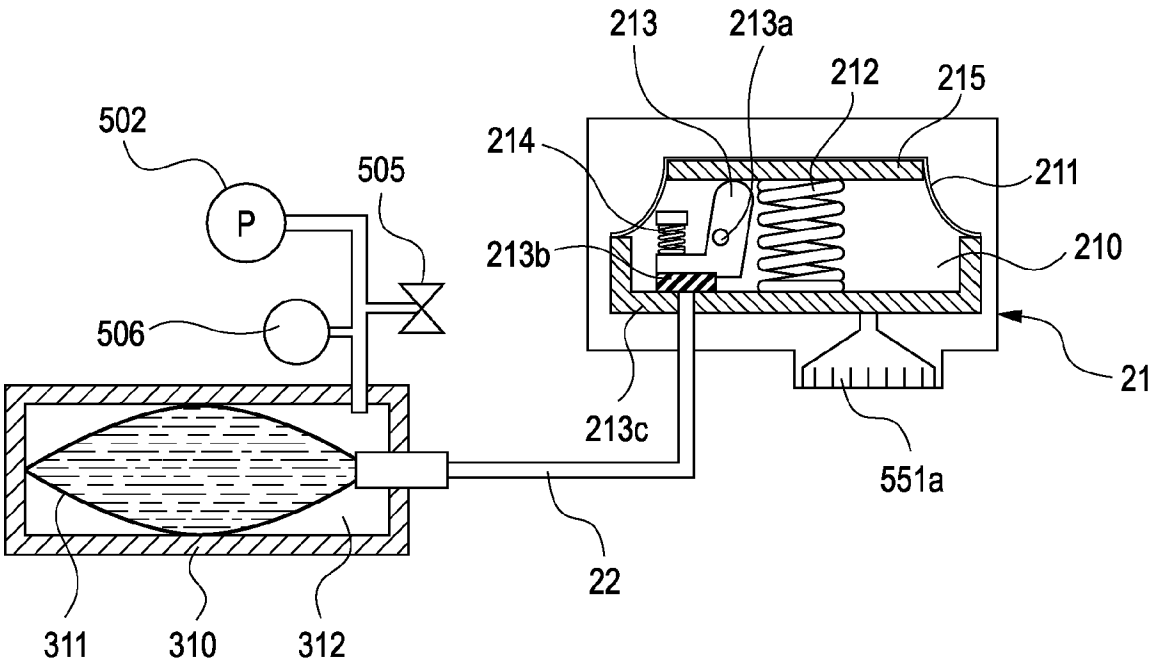
FIG. 4 is a schematic illustration showing a system according to the embodiment.

Referring to FIG. 4, description will be provided for the main tank 301 fixed to the printing apparatus of an indirect pressure supply system and the subtank 21 which is mounted on the printing head 5 and is supplied with the liquid from the main tank 301.

The main tank 301 includes a liquid bag 311 which is housed in a case 310 and contains liquid, and an air pressure chamber 312 which is a space between the case 310 and the liquid bag 311.

The supply tube 22 is a passage through which the liquid in the main tank 301 is pumped to the subtank 21. The subtank 21 includes a negative pressure chamber 210 which contains the liquid. The negative pressure chamber 210 has a negative pressure ranging from −50 to −200 mmAq applied thereto, to keep proper meniscus at a discharge port 551*a* of the printing head 5. A soft film 211 is provided around a plate member 215. The plate member 215 defines an upper wall of the negative pressure chamber 210. The plate member 215 can move in accordance with a change in inner volume of the negative pressure chamber 210. A negative pressure spring 212 is a compression spring arranged in the negative pressure chamber 210. The negative pressure spring 212 urges the plate member 215 in a direction in which the inner volume of the negative pressure chamber 210 expands. The inside of the negative pressure chamber 210 is kept to a negative pressure condition because of an action of the negative pressure spring 212.

A supply limiting valve 213 shuts off the liquid supplied from the supply tube 22. The supply limiting valve 213 is supported rotatably around a rotational axis 213*a*.

When the subtank 21 is filled with the liquid, an end of the supply limiting valve 213 is rotationally urged by a supply limiting spring 214 which is a compression spring, and the end is pressed to a valve seat 213*c*. A valve body 213*b* is provided at the end of the supply limiting valve 213. The valve body 213*b* is formed of a soft and elastic material, such as rubber. Hence, the valve seat 213*c* is sealed, so that a flow of liquid from the supply tube 22 to the negative pressure chamber 210 is shut off. The supply limiting valve 213 is closed while the negative pressure chamber 210 is filled with the liquid by an amount which does not cause the film 211 to be completely stretched. With this configuration, even when the inside of the air pressure chamber 312 of the main tank 301 is in a pressure-applied condition, the printing head 5 is not excessively supplied with the liquid and hence the liquid does not leak from the discharge port 551*a*.

When the liquid in the subtank 21 is consumed, the plate member 215 in the subtank 21 is lowered, and presses down an upper end of the supply limiting valve 213. The supply limiting valve 213 rotates clockwise around the rotational axis 213*a*. The valve body 213*b* at a lower end of the supply limiting valve 213 is separated from the valve seat 213*c*, the valve body 213*b* shutting off the supply tube 22 is released, and the liquid is supplied.

When the subtank 21 becomes full, the plate member 215 pressing down the supply limiting valve 213 is displaced upward. Accordingly, the supply limiting valve 213 is released from a pressing force of the plate member 215, and is rotated counterclockwise by the supply limiting spring 214. Thus, the valve body 213*b* is pressed to the valve seat 213*c* and hence the valve body 213*b* is closed.

4. Pressure Unit, Pressure Detecting Unit

Figure 3:
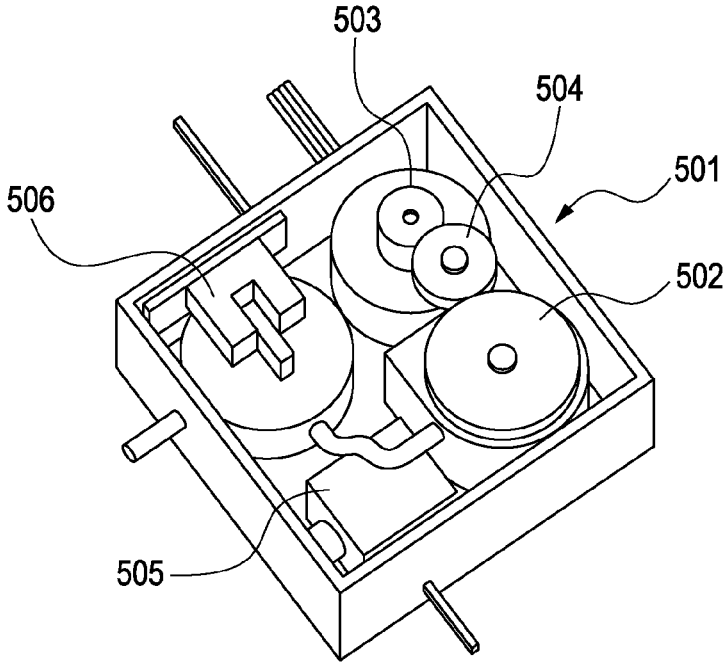
FIG. 3 is a perspective view briefly showing a pressure pump according to the embodiment.

FIG. 3 is a perspective view showing an appearance of the pressure pump unit 501. The pressure pump unit 501 serving as a pressure unit is arranged below the main tank 301 in FIG. 1. The pressure pump unit 501 includes a pressure pump 502 formed of a tube pump, a pressure pump motor 503 serving as a driving unit, and a driving gear train 504. A solenoid operated valve 505 closes a connection between the air passage and the ambient air only while a voltage is applied to the solenoid operated valve 505.

A pressure sensor 506 serves as a pressure detecting unit. The pressure sensor 506 includes a diaphragm formed of rubber and a spring, and a transmission-type photo interrupter, which detects a displacement of the diaphragm. In the pressure pump unit 501, the pressure sensor 506 detects a pressure in the air passage through which the air is supplied from the pressure pump 502 to the air pressure chamber 312 of the main tank 301 (see FIG. 2). Using the pressure sensor 506, it is determined whether the pressure in the air passage is higher or lower than a predetermined pressure. The predetermined pressure is a pressure or higher, the pressure which allows the liquid to be supplied with a liquid amount for suction and exhaustion of liquid during nozzle cleaning, or with a liquid amount for printing with a maximum liquid consumption. Further, the pressure desirably takes into account a pressure loss of a passage from the main tank 301 to the supply limiting valve 213. Furthermore, it is desirable that the pressure is a pressure which reliably provides pressure resistance reliability of the passage. The pressure satisfying those conditions are determined as a detection threshold of the pressure sensor 506. The pressure to be detected may be the pressure in the air pressure chamber 312 of the main tank 301, or a pressure of the liquid in the passage between the main tank 301 and the subtank 21 to directly detect the pressure of the liquid.

In this embodiment, as the predetermined pressure, the detection threshold of the pressure sensor 506 is determined to +15 kPa which is a pressure lower limit. The pressure lower limit is determined to a pressure which does not cause insufficient supply of the liquid. In particular, the predetermined pressure is determined as a numerical value larger than the sum of the pressure loss of the passage extending from the main tank 301 to the supply limiting valve 213 and a detection tolerance of the pressure sensor 506 when the liquid flows by a maximum amount defined in a product specification.

At start of printing, when the pressure sensor detects that the pressure reaches the pressure lower limit, the pressure unit is driven by a predetermined amount, and then the pressure unit is stopped. During printing, when the pressure sensor 506 detects that the pressure is lower than the pressure lower limit, the operation, in which the pressure unit is driven by the predetermined amount again and then the pressure unit is stopped, is repeated, so that the pressure force is kept within a predetermined range.

5. Configuration of Liquid Supply

FIG. 4 is a schematic illustration showing a system according to the embodiment. When the printing apparatus is in a standby condition, the solenoid operated valve 505, which is provided in a path between the air pressure chamber 312 and the pressure pump 502 for applying a pressure to the air pressure chamber 312, is released. In this condition, the air pressure chamber 312 is in an ambient air release condition. No pressure is applied to the main tank 301. Hence, the liquid supply to the subtank 21 is not performed.

In a printing condition, the solenoid operated valve 505 is closed and the air pressure chamber 312 is sealed. The pressure pump 502 is driven by the pressure pump motor 503, and the air is pumped to the air pressure chamber 312 of the main tank 301. With the pressure, the liquid bag 311 in the main tank 301 is pushed, and the liquid is supplied to the subtank 21 via the supply tube 22. The liquid supply from the main tank 301 to the subtank 21 is performed when the liquid in the negative pressure chamber 210 of the subtank 21 is consumed.

When the pressure limiting valve 213 is closed, the liquid is not supplied even when the air pressure chamber 312 in the main tank 301 is in the pressure-applied condition. When the liquid in the subtank 21 is consumed from this condition, the supply limiting valve 213 is opened again, the liquid flows from the main tank 301 to the subtank 21, and the subtank 21 is filled with the liquid. As described above, as long as the pressure in the air pressure chamber 312 is kept to a predetermined pressure or higher so that a liquid supply performance exceeds a liquid consuming speed, the amount of liquid in the subtank 21 is constantly kept to be substantially full.

6. Control

Figure 7:
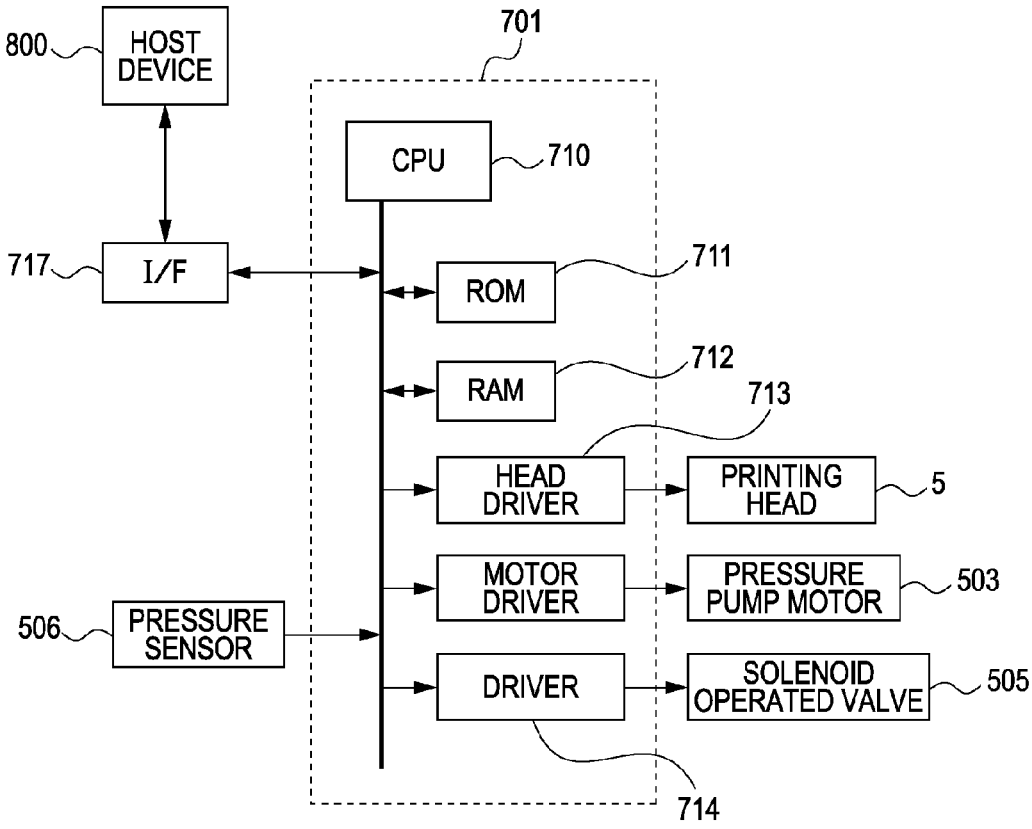
FIG. 7 is a control block diagram according to the embodiment.

FIG. 7 is a control block diagram. A control circuit 701 serves as a control unit. The control circuit 701 includes a CPU 710 which outputs various control instructions, and a ROM 711 which stores control data. The ROM 711 also stores a correspondence table between the liquid consuming speed and the power of the driving unit as shown in Table 1. In addition, the control circuit 701 includes a RAM 712 which is a region in which data is temporarily stored and image information is developed, and a head driver 713 which drives the printing head 5. A driver 714 drives other motors and solenoids. An interface 717 transmits data to and from a host device 800 such as a computer, a digital camera, etc.

A feature of an aspect of the invention is to control a driving speed of the pressure unit in accordance with the liquid consuming speed of the printing unit. Hence, in the following embodiments, specific examples of control methods will be described.

First Embodiment

Control of Pressure Unit by Counting Droplets

A liquid consumption per unit time (liquid consuming speed) varies in accordance with a density of an image to be printing (printing duty). The liquid consumption per unit time can be calculated by counting the number of droplets which are discharged per unit time, and multiplying the counted value by an amount of liquid of a droplet.

Figure 5:
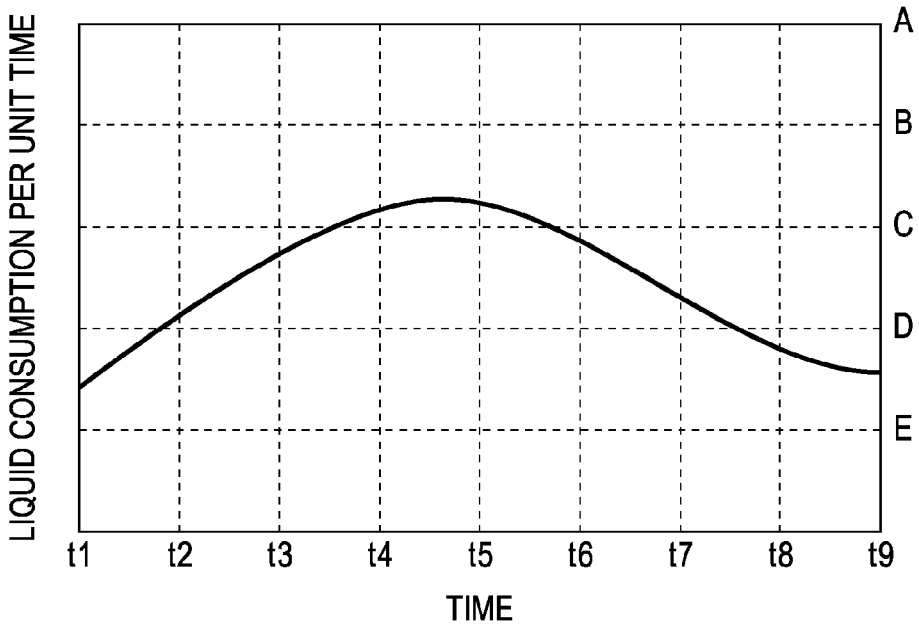
FIG. 5 illustrates an example of transition of a liquid consuming speed according to the embodiment.

FIG. 5 illustrates an example of transition of the liquid consumption per unit time when an image is continuously printed from a time t1 to a time t9. In the period from t1 to t9, when the pressure sensor 506 detects an insufficient pressure of the air pressure chamber 312 in the main tank 301, the pressure pump motor 503 drives the pressure pump 502. However, the pressure pump 502 does not have to be driven with a maximum power when the liquid consuming speed is low. In this embodiment, the pressure pump 502 is driven with a power corresponding to the current liquid consuming speed. The power for driving the pressure pump 502 is controlled through speed control of the pressure pump motor 503.

Figure 6:
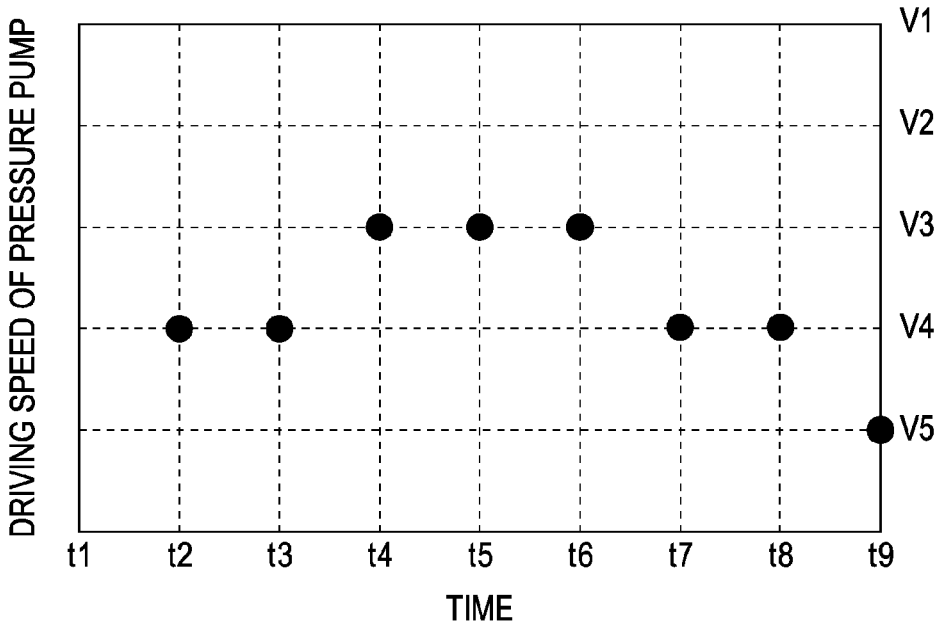
FIG. 6 illustrates a selection result of a driving speed of the pump according to the embodiment.

Table 1 is a correspondence table of the driving speed of the pressure unit, the driving speed being selected in accordance with the liquid consumption per unit time. FIG. 6 illustrates the actually selected driving speed with time lapse. Herein, pump driving speeds V1 to V5 have a relationship of "V1>V2>V3>V4>V5," and maximum liquid consumptions A to E per unit time have a relationship of "A>B>C>D>E."

TABLE 1

| | Liquid consumption (max) per unit time | | | | | |
|---|---|---|---|---|---|---|
| | A or more | Less than A and B or more | Less than B and C or more | Less than C and D or more | Less than D and E or more | Less than E |
| Pump driving speed | V1 | V2 | V3 | V4 | V5 | V5 |

When a pressure has to be applied to the main tank 301 at t4 in FIG. 5, a liquid consumption per unit time (liquid consuming speed) in a predetermined time Δt immediately before that time, i.e., in the case of t4, in a range of from t3 to t4, is referred. Then, a maximum consuming speed within the range is obtained. As a result, the maximum value is between B and C. A driving speed is selected from Table 1, and V3 is determined.

In this embodiment, specific values of A to E and V2 to V5 are as follows: A=6 (g/min), B=4 (g/min), C=3 (g/min), D=2 (g/min), E=1 (g/min), V1=80 (rpm), V2=(rpm), V3=40 (rpm), V4=25 (rpm), and V5=10 (rpm).

Herein, when the unit time Δt is used to obtain the consuming speed, the unit time Δt may be divided into short time sections, each of which ranges from 0.5 second to 3 seconds. In a case where Δt is too large, for example, if Δt is a time from a previous pressure application to a current pressure application, Δt may include a time of a sheet feeding operation etc. during driving for the pressure application. Hence, such a time may involve an element which may interrupt calculation of the maximum consuming speed of the liquid. In this embodiment, since Δt is 1 second, a liquid consuming speed during current printing can be accurately predicted. FIG. 6 illustrates driving speeds of the pressure pump, which are selected when the detection value is below +15 kPa at every point from t2 to t9 and the pressing unit has to be driven.

Typically, when the printing apparatus is driven, sound is generated because of carriage movement or sheet feeding. If the motor sound of the pressure pump is markedly larger than that sound, the motor sound may be noticeable to the user. In the related art, a motor has been operated at a driving speed corresponding to V1 of this embodiment at all timings when pressure reduction is recognized. The motor intermittently generates large sound although the motor is driven for a short time. In this embodiment, the driving at V1 is used for suction and exhaustion of liquid during nozzle cleaning. V1 is not frequently selected.

The user does not notice the motor sound if the motor sound is as large as other sound of sheet feeding etc. In this embodiment, driving at V2 or higher can restrict noticeable sound. As described in the first embodiment, motor sound is significantly restricted as compared with the related art during typical printing, in which driving at V3 is mainly performed.

The motor driving time becomes longer than that of the related art, however, the printing time is not increased. That is, in the related art, the motor is driven for a short time and then is stopped for a long time (stop condition). In contrast, in this embodiment, driving continues in a period corresponding to the stop condition (waiting time) of the related art.

Typically, the life of a drive portion (for example, motor) of the pressure unit closely relates to the driving speed. With the embodiment which can properly control the driving speed, wasteful use and energy consumption of the drive portion of the pressure unit can be reduced. Further, the printing apparatus with a reduced weight is likely affected by vibration. The embodiment which can reduce motor vibration due to the driving speed of the motor is suitable for the printing apparatus with the reduced weight.

Next, the control of the embodiment will be described below with reference to a flowchart shown in FIG. 8. In response to reception of a print command, electricity is applied to the solenoid operated valve 505, and the solenoid operated valve 505 is closed (step S801). The value of the pressure sensor 506 is detected (step S802). If the value does not reach a predetermined pressure (in the embodiment, +15 kPa as a gauge pressure), the pressure pump motor 503 drives the pressure pump 502 (step S803). At this time, the driving speed is V3, which is a speed taking into account a balance between a time to a printable condition and noise.

When the pressure sensor 506 detects that the pressure reaches the predetermined pressure, the pressure pump 502 is further driven for pressure application by two rotations and then stopped in step S804. Thus, the pressure when the pressure pump 502 is stopped is a value slightly larger than +15 kPa.

Here, the reason of further driving the pressure pump 502 (by two rotations) after the pressure sensor 506 detects the pressure, will be described below. Since the embodiment uses the pressure sensor 506 capable of detecting a single pressure of +15 kPa, when the pressure sensor 506 makes a response, it means that the actual pressure is below a pressure lower limit. Supplying the liquid requires a higher pressure than the pressure lower limit. Owing to this, the pressure pump 502 is excessively driven after the detection of the pressure sensor 506. For example, when a pressure sensor is employed which uses a piezoelectric element and is capable of continuously detecting values from 0 to +20 kPa, control may be performed such that pressure application is started when a detected pressure is below +15 kPa and the pressure application is stopped when the detected pressure reaches +17 kPa.

In step S805, printing is performed. During printing, when the pressure sensor 506, serving as a pressure detecting unit, detects that the pressure is below +15 kPa of the predetermined value in step S806, the procedure goes to step S807. In step S807, a maximum value of liquid consumption per unit time at a predetermined time Δt, which is immediately before the current time, is obtained, and a driving speed of the pressure pump 502 is selected from Table 1 stored in a memory. The pressure pump 502 is driven at the selected driving speed.

For example, when multipath photo printing is performed on special paper, the liquid consuming speed is low, and hence the driving speed V of the pressure unit is low. In contrast, when single-path printing for a high-density image, such as a graph or an illustration, is performed on normal paper, the liquid consuming speed is high and the driving speed V of the pressure pump 502 is high.

When a predetermined time, for example, three seconds have elapsed since the start of driving, it is detected whether the pressure reaches +15 kPa (step S808). If the pressure has reached the predetermined pressure, it is determined that the pressure application is normal. Then, the procedure goes to step S814.

If a difference between the predicted liquid consumption and the actual liquid consumption increases, for example, because the consuming speed rapidly varies although the control is performed, the pressure cannot reach a target value even if the pressure pump 502 is driven by a predetermined amount. When the pressure is continuously insufficient, discharge failure may occur. In step S809, if the pressure sensor 506 has not detected the predetermined pressure when a certain time, for example, three seconds have elapsed since the start of driving, the driving speed is increased by one step from the selected driving speed (for example, driving speed at a higher level), and the driving is continued. In step S810, if the predetermined pressure is detected within, for example, two seconds, printing is continued under the normal control.

If the predetermined pressure is not detected in step S810, a maximum speed is selected for driving the pressure pump 502 in step S811, and the pressure application is continued. Further, if it is determined that the pressure does not reach the target pressure when a predetermined time has elapsed in step S812, an error such as leakage of the liquid may occur in the middle of a passage. Hence, the driving of the pressure pump 502 is stopped in step S813, and error processing is performed.

If the pressure pump 502 has been already driven at the maximum speed V1 in steps S807 and S809, there is not provided higher speed setting. Hence, an error may be judged in either of step S808 or S810.

When it is determined that the normal pressure application is performed, the pressure pump 502 is further rotated by two rotations in step S814, and the pressure is set to a value slightly higher than +15 kPa.

When there is no remaining print data in step S815, the pressure detection is stopped, the pressure pump 502 is no longer driven, and becomes in a standby condition. Further, when there is no print data even when the print waiting condition has been continued for a predetermined time (for example, 180 seconds) in step S816, the solenoid operated valve 505 mounted on the pressure pump 502 is opened in step S817, so that the pressure is released, and the pressure pump 502 becomes in the standby condition.

Printing may be normally performed regardless of the control condition of the liquid supply mechanism from step S805 (start of printing) to S815. The embodiment does not increase the printing time. The pressure application is not performed, regardless of the detected pressure, until the predetermined time elapses after printing is ended and there is no remaining print data in FIG. 8. Alternatively, another method may be employed. For example, when a decrease in pressure is detected while there is no remaining print data, the pressure application may be started at a minimum driving speed, to prepare to immediately restart printing in a case where next print data is provided. Further, in the embodiment, the pressure is released when 180 seconds has elapsed, the pressure pump may become the standby condition without releasing the pressure.

Second Embodiment

Control of Pressure Unit in Accordance with Printing Medium and Printing Mode

In this embodiment, a liquid consuming speed is obtained by using at least one of a printing medium and a printing mode.

The liquid consuming speed during printing may vary depending on the type of printing sheet and the printing mode. Regarding the type of printing sheet, coated paper, which is used as photo paper, has a larger liquid absorption capacity per unit area as compared with normal paper. Typically, expensive photo paper is used for photo printing. Hence, print quality is important. To prevent the print quality from decreasing because of scanning unevenness of a head, multipath printing is performed, in which printing in a certain area is performed a plurality of times (overlays). Hence, the liquid consuming speed is low.

In contrast, normal paper has a smaller liquid absorption capacity per unit area as compared with photo paper. Also, this type of printing is frequently used for printing business documents, the print quality of which does not have to be high. Images and characters are formed by performing printing a fewer number of times than that of photo paper. In many cases, a discharge frequency of the nozzles is set to a substantially maximum value so that the speed is increased. Thus, the liquid consuming speed is typically higher than that of photo paper.

In addition, there is provided substantially three printing modes for such printing sheets. The modes include "fine," "standard," "fast" or other similar expressions, in the order from a higher print quality. The fine mode provides a larger number of overlays by multipath printing than the standard mode does. Thus, the liquid consuming speed is low. The fast mode provides a decreased number of overlays and a higher discharge frequency although the print quality is decreased by a certain degree, thereby increasing the speed. Thus, in many cases, the liquid consuming speed is high. The fast mode may perform reduced discharge such as when draft printing is performed. Thus, the liquid consuming speed may be low depending on the rate of reduced discharge.

Typically, during printing on normal paper in the standard mode, liquid is continuously discharged from all liquid discharge ports at a maximum discharge frequency. Accordingly, the liquid consuming speed is high. Also, during printing on photo paper, multipath printing is performed by performing printing a plurality of times in a certain area. Thus, the liquid consuming speed is low.

Hence, in this embodiment, a driving speed of a motor (pressure unit) of a pressure pump is set to be higher for normal paper, and a driving speed for photo paper is set to be lower than that of normal paper as shown in Table 2. Herein, the relationship of V1>V2>V3>V4>V5 is still established.

TABLE 2

| | Paper | | | | | | | | | |
|---|---|---|---|---|---|---|---|---|---|---|
| | Photo paper | | | Matte paper | | | Normal paper | | | ... |
| Printing mode | Fast | Standard | Fine | Fast | Standard | Fine | Fast | Standard | Fine | ... |
| Pump driving speed | V3 | V4 | V5 | V2 | V3 | V4 | V1 | V2 | V3 | ... |

Figure 8:
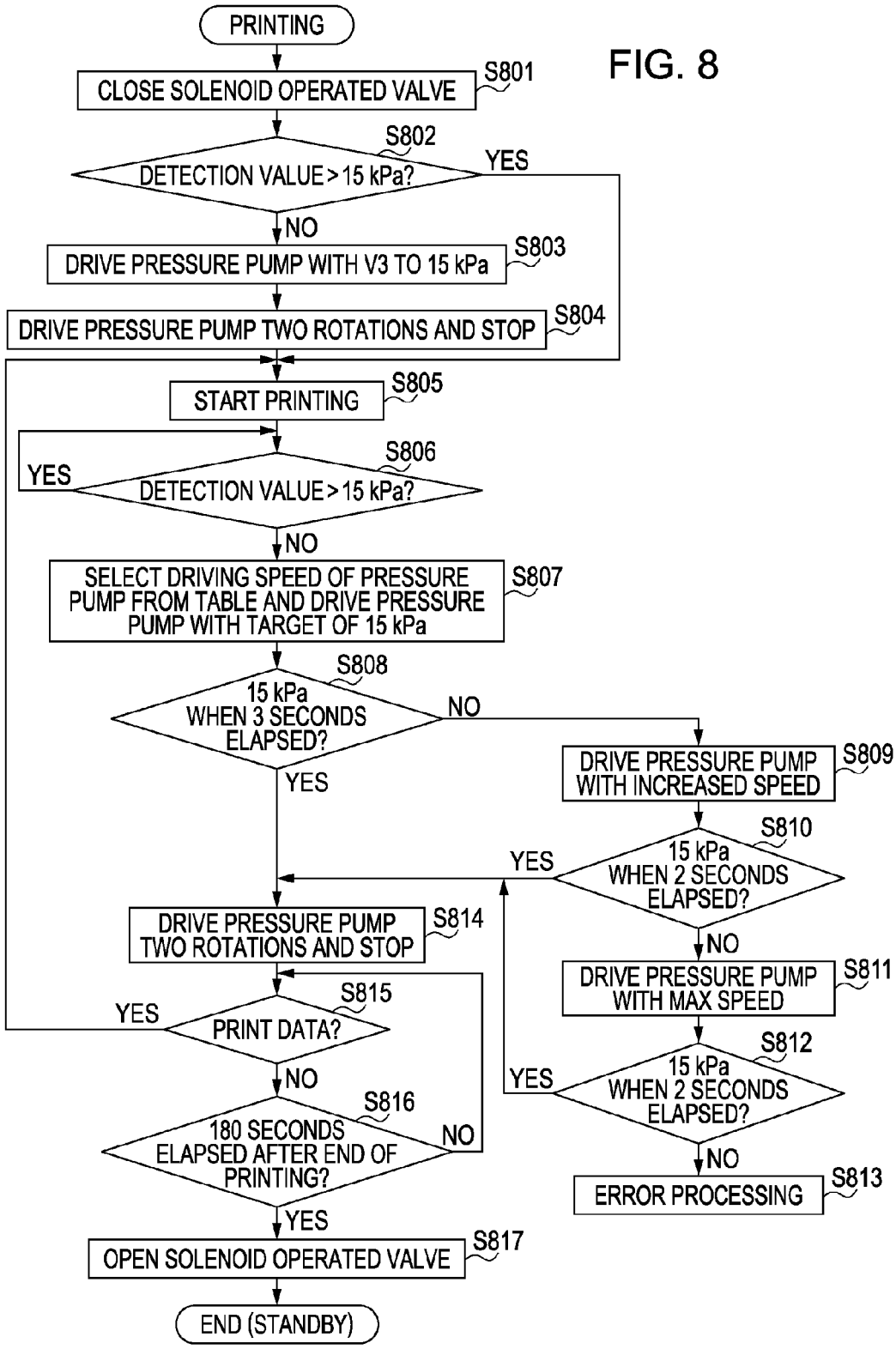
FIG. 8 is a flowchart showing control according to the embodiment.

In the second embodiment, the control of the flowchart in FIG. 8 may be performed. The second embodiment is different from the first embodiment in that, in step S807 of the flowchart in FIG. 8, Table 2 is referred for selection of the driving speed of the motor (pressure unit) on the basis of information on the type of printing medium and information on the printing mode. In step S807, the driving speed is selected with reference to Table 2 on the basis of, for example, information on the type of printing medium and information on the printing mode sent from the host device 800. The pressure pump motor 503 is rotated at the selected driving speed, to drive the pressure pump 502.

Hereinafter, the control similar to the first embodiment is performed. With the second embodiment, counting of droplets or calculation of liquid amount may be omitted. The load applied to the control unit can be decreased. With the configuration, it is not necessary to continuously estimate the liquid consumption. The load applied to the calculation unit can be decreased.

The liquid consuming speed does not have to be calculated in the manner described in the embodiments. The liquid consuming speed may be calculated by using a combination of "the image data," "the printing medium," and "the printing mode."

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-260708 filed Oct. 7, 2008, which is hereby incorporated by reference herein in its entirety.

What is claimed is:

1. A printing apparatus comprising:

a printing unit configured to discharge liquid from a printer nozzle and perform printing on a printing medium;

a first tank configured to contain liquid to be supplied to the printing unit;

a second tank configured to contain liquid to be supplied to the first tank;

a pump configured to apply a pressure to the second tank so as to supply liquid from the second tank to the first tank;

a detecting unit configured to detect an internal pressure of the second tank; and a control unit configured to cause the pump to be driven at a first driving speed, determined based on information of the printing medium and information of a printing mode, during a first predetermined period of time in a case where the internal pressure is lower than a predetermined value, wherein, in a case where the internal pressure does not exceed the predetermined value after the pump is driven at the first driving speed during the predetermined period of time, the control unit causes the pump to be driven at a second driving speed being faster than the first driving speed during a second predetermined period of time.

2. The printing apparatus according to claim 1, wherein the control unit determines the first driving speed of the pump based on a table showing a correspondence of the information of the printing medium and the information of the printing mode to a driving speed.

3. The printing apparatus according to claim 1, further comprising a carriage configured to move with the printing unit and the first tank mounted thereon.

4. The printing apparatus according to claim 3, further comprising a tube through which the ink contained in the second tank is supplied to the first tank, wherein the second tank is provided in an apparatus body.

5. The printing apparatus according to claim 1, further comprising a pump unit provided with the pump, wherein the detecting unit is provided in the pump unit.

6. The printing apparatus according to claim 1, wherein the second predetermined period of time is shorter than the first predetermined period of time.

7. The printing apparatus according to claim 1, wherein, in a case where the internal pressure does not exceed the predetermined value after the pump is driven at the second driving speed during the predetermined second period of time, the control unit causes the pump to be driven at a maximum speed during a third predetermined period of time.

8. The printing apparatus according to claim 1, wherein, in a case where the internal pressure does not exceed the predetermined value after the pump is driven at the maximum speed during the predetermined third period of time, the control unit performs control so that the driving of the pump is stopped and an occurrence of an error is determined.

* * * * *